United States Patent [19]

Hayes et al.

[11] Patent Number: 4,697,864

[45] Date of Patent: Oct. 6, 1987

[54] PRINTED CIRCUIT BOARD RECEPTACLE FOR SEALED CONNECTOR

[75] Inventors: Earl J. Hayes, Advance; Ralph M. Cooper, Clemmons, both of N.C.; Keith R. Denlinger, Lancaster; John R. Shuey, Mechanicsburg, both of Pa.

[73] Assignee: AMP Incorporated, Harrisburg, Pa.

[21] Appl. No.: 876,970

[22] Filed: Jun. 19, 1986

[51] Int. Cl.[4] ..... H01R 9/09

[52] U.S. Cl. ..... 439/444; 439/692; 439/741

[58] Field of Search ..... 339/17 LC, 220 R, 221 R, 339/221 M, 217 S, 258 R, 258 P, 94 R, 94 A, 94 C, 94 M, 206 R, 206 P, 207 R, 207 S, 126 R, 126 RS, 132 R, 132 B, 93 R, 93 C, 176 M, 92 R, 92 M, 65

[56] References Cited

U.S. PATENT DOCUMENTS

| | | | |
|---|---|---|---|
| 3,351,894 | 11/1967 | Kinkaid | 339/217 S |
| 3,493,916 | 2/1970 | Hansen | 339/217 S |
| 4,186,988 | 2/1980 | Kobler | 339/176 MP |
| 4,193,654 | 3/1980 | Hughes et al. | 339/17 LC |
| 4,225,209 | 9/1980 | Hughes | 339/126 R |
| 4,491,376 | 1/1985 | Gladd et al. | 339/17 LC |
| 4,550,962 | 11/1985 | Czeschka | 339/17 LC |

OTHER PUBLICATIONS

Japanese Publication 59-161510.

*Primary Examiner*—John McQuade
*Attorney, Agent, or Firm*—Eric J. Groen

[57] ABSTRACT

A high density receptacle has a right-angled configuration having pins extending from a mounting face for interconnection to a printed circuit board. A second face is mountable to a bulkhead and has three rows of pins mounted in a cavity recessed from the second mounting face for interconnection to a matable plug having socket contacts. The contacts within the receptacle are disposed in three tiers, the contacts being bent around mandrels to form the right-angled bend. Below the mandrels is a contact locating plate having contact receiving slots in line with the contacts. The upper and lower row of contacts are laterally aligned with each other and with a first contact receiving slot. The first slot has two widths, and has a rib extending down along the edges of the slot. When the contacts are placed in the slot, the ribs interferingly hold the contacts in place. The second row of terminals is also aligned with a contact receiving slot having ribs for interferingly locking the second row of terminals in place.

7 Claims, 14 Drawing Figures

300
308
314
34
32
2
302
18
314
308
36
14
110
490
410
500
560
400
548
544
580
550
562
466
560
500
502

Fig. 8
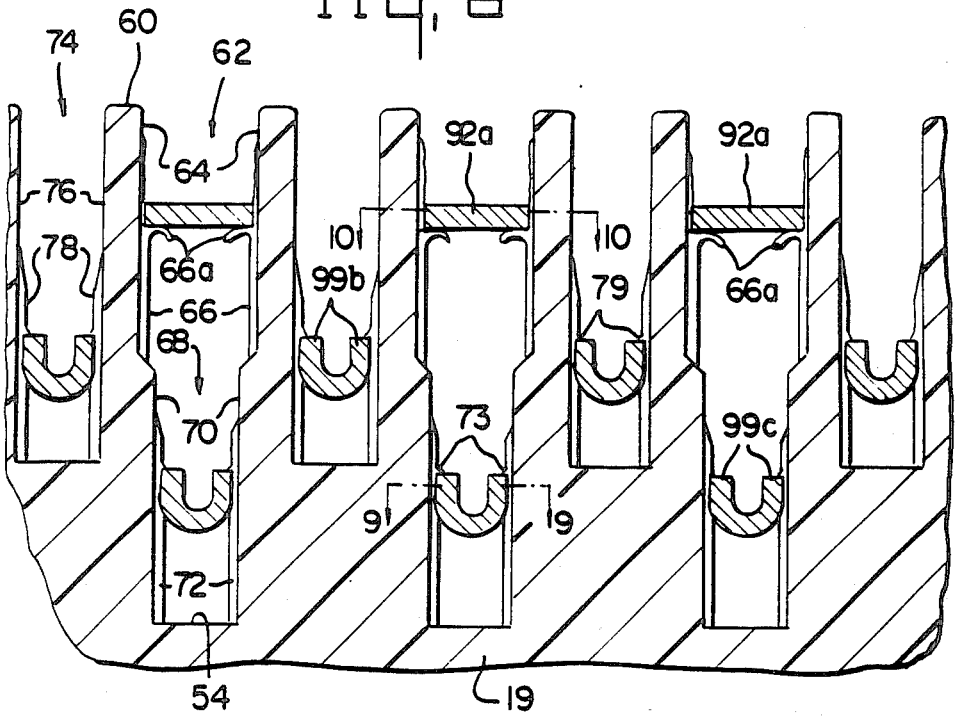
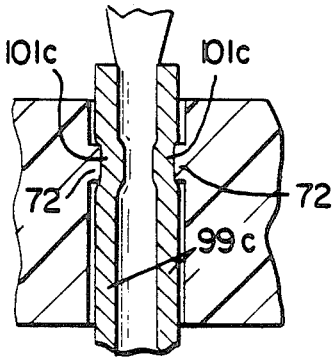
Fig. 9
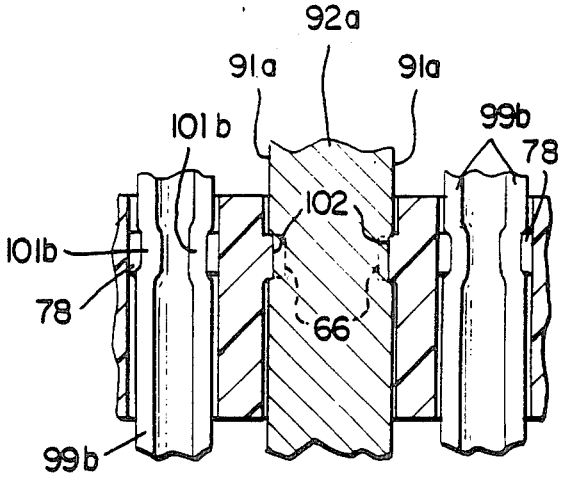
Fig. 10

PRINTED CIRCUIT BOARD RECEPTACLE FOR SEALED CONNECTOR

BACKGROUND OF THE INVENTION

1. Field of the Invention

The instant invention relates to a high density interconnect between a printed circuit board and a multiconductor cable having socket contacts within a mating plug. The connector has a right-angled connection to the printed circuit board and an interfacial seal between the connector mounting face and a mounting bulkhead.

2. Prior Art

There is disclosed in U.S. Pat. No. 3,351,894 to Kinkaid a right-angled connector for mounting on a printed circuit board and for interconnection to a socket plug. This connector however doesn't allow for high-density interconnections in that there is only a single row of contacts mounted to the printed circuit board. If the contacts cannot be stacked vertically from the printed circuit board, more real estate on the printed circuit board is required for interconnections.

U.S. Pat. No. 4,186,988 to Kobler FIG. 10, and U.S. Pat. No. 4,193,654 FIG. 3 and U.S. Pat. No. 4,225,209 FIG. 1, to Hughes show an alternate design for staggering contacts in order to increase the use of printed circuit board space.

U.S. Pat. No. 4,491,376 to Gladd et al. shows a right-angled mount connector for mounting on a printed circuit board having solid pin contacts wherein two pins are laterally aligned within the connector, one above the other, each pin then bent downwardly for interconnection to the printed circuit board. In Gladd however, the pins have lateral projections which scive the interior cavity walls upon insertion, and embed within the walls. Thus, the pin contacts have no means for being accurately placed within the cavities. Furthermore, once in place, it is difficult to maintain the pin contacts in a fixed axial position, as the contacts have no positive stops.

In Gladd et al., the pin contacts are bent downwardly into longitudinal slots for receipt into detents. Using detents for the placement of the pin contacts allows the contacts to move with the respective slots, becoming misaligned with respect to the printed circuit board.

Japanese application Ser. No. 59-161510 published Mar. 1, 1986 utilizes a plurality of terminals formed from tamped and formed contacts. This connector however, does not have a means for accurately locating each terminal end in each respective row with respect to the mating face 11. Furthermore in the Japanese application, the connector includes shoulders in the respective channels for maintaining the contacts in proper alignment. The die tooling for this type of draw molding application is expensive to purchase and to operate.

SUMMARY OF THE INVENTION

The subject invention relates to a high density connector for right angle mounting on printed circuit boards. The connector housing has a cavity for receiving a plurality of contacts disposed in parallel rows. The cavity of the housing is defined by a back wall having apertures extending through the housing, the apertures for receiving the contacts in the parallel rows. At least two rows of the contacts are aligned laterally. The apertures extend from the back wall and are contiguous with channels formed in mandrels extending from the rearward side of the housing. Positioned between the channels and the apertures are back surfaces, transverse to the direction of the apertures. The mandrels are used for bending the contacts therearound, an upper mandrel extending further outward from the back wall than a lower mandrel, axially positioning the upper contacts away from the lower contacts. A lower row of apertures extend into and through the cavity back wall and are bent downwardly lying substantially flush against the back wall.

The contacts are stamped and formed having a pin end, an intermediate shank portion and an end portion formed by two upstanding arms formed in a U-shaped cross section. Intermediate the pin end and the shank portion is located an upstanding portion to contact and abut the back surface in the channel to accurately position the contact axially in the aperture.

Extending from the back wall of the housing beneath the upper and lower mandrels is a contact locating plate having slots in lateral alignment with the contacts. The upper and lower contacts are laterally aligned and are located in one slot which extends from the end of the locating wall to the back wall of the housing. A laterally offset slot is provided to locate the middle row of contacts.

BRIEF DESCRIPTION OF THE DRAWINGS

FIG. 3 is a perspective view of the receptacle cutaway to show the internal structure.

FIG. 4A is a cross-sectional view taken through lines 4A—4A of FIG. 4.

FIG. 8 is a view similar to that of FIG. 7 showing the three tiers of terminals in greater detail.

FIG. 9 is a cross-sectional view through lines 9—9 of FIG. 8.

FIG. 10 is a cross-sectional view through lines 10—10 of FIG. 8.

FIG. 13 is a cross-sectional view similar to that of FIGS. 11 and 12 showing the receptacle and plug portions fully mated.

DETAILED DESCRIPTION OF THE PREFERRED EMBODIMENT

The subject matter disclosed herein is related to application Ser. No. 876,525, entitled "Sealed Plug for a Printed Circuit Board Receptacle"; application Ser. No.

876,549, entitled "Receptacle and Plug Assembly"; and application Ser. No. 876,159, entitled "Sealing Member for Bulkhead Connector", all filed concurrently herewith. The above-mentioned applications are incorporated herein by reference.

Figure 1:
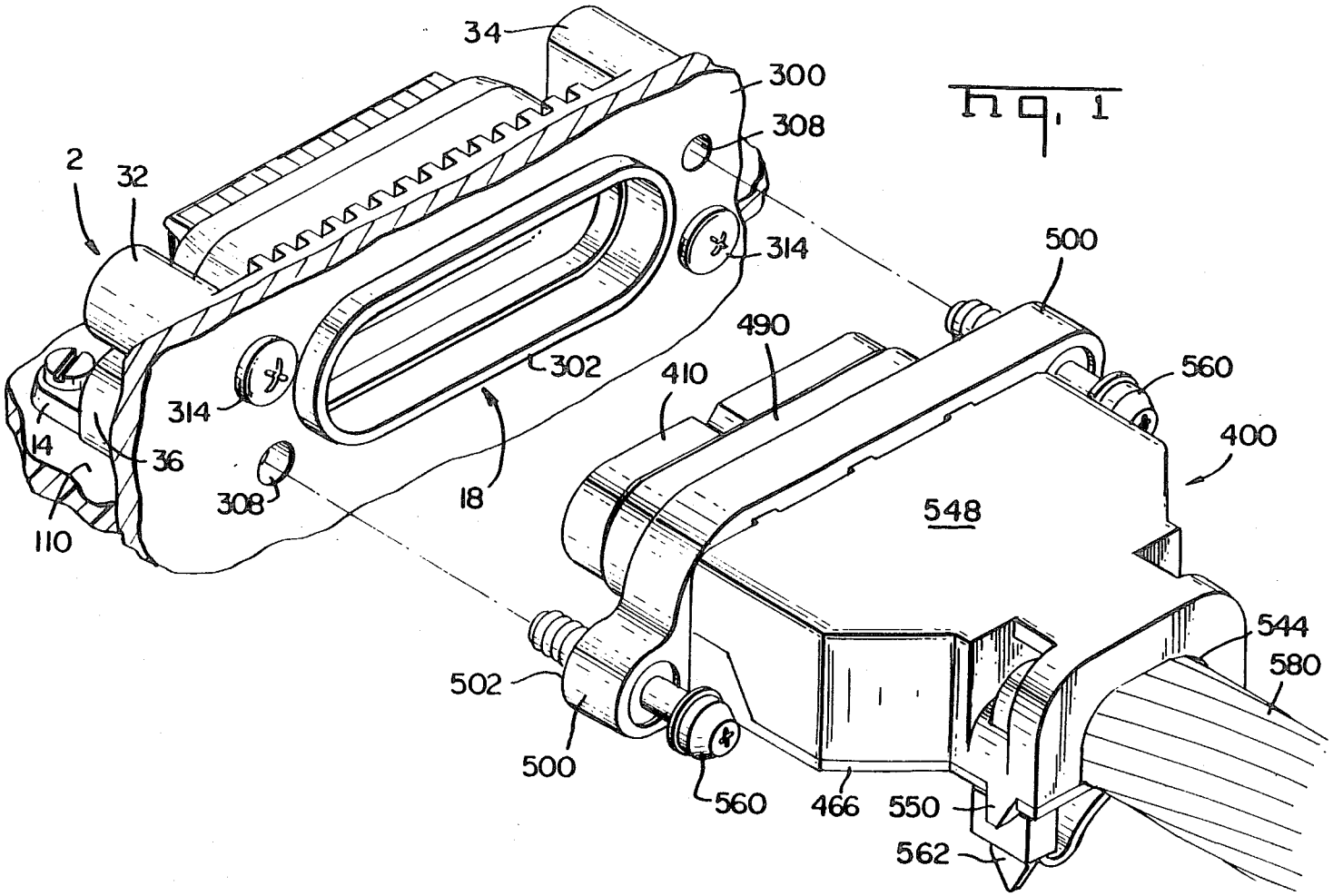
FIG. 1 is a perspective view of the preferred embodiment of the receptacle of the instant invention shown exploded away from a mateable plug assembly.

Referring to FIG. 1, the subject connector 2 is shown mounted to a bulkhead 300, such as a sealed "black box" for use in automotive controls. The connector 2 can be totally enclosed within the black box except for the plug receiving cavity 18, which is left exposed for receiving the plug 400. The connector 2 is also shown in FIG. 1 as having a printed circuit board 110 attached to the connector, the connector 2 for interconnecting the circuitry on the printed circuit board 110 with individual wires via the plug 400.

Figure 2:
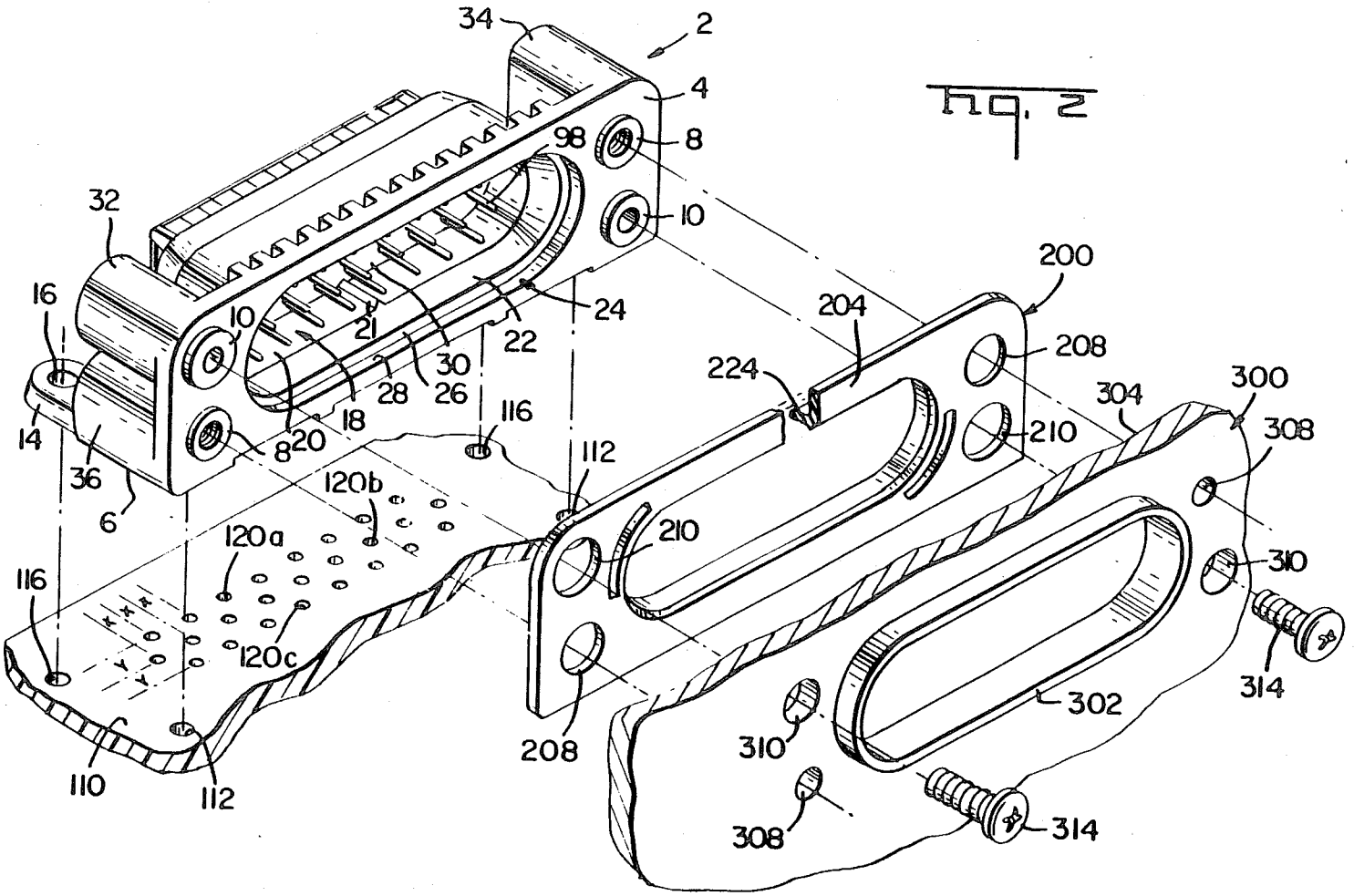
FIG. 2 is a perspective view of the receptacle exploded away from the mounting bulkhead and the printed circuit board.

Referring more specifically to FIG. 2, connector 2 is shown in greater detail. The connector 2 has a front mating face 4 having a plug receiving cavity 18 therein. The cavity 18 is defined by a frustoconical surface 22, an oblong surface 20 and back surface 30. At the intersection of the cavity 18 and the front mating surface 4 is a gasket seat, shown generally as 24, which includes cylindrical surface 28 and back surface 26. The front mating surface 4 further includes alignment bosses 10 and threaded inserts 8. Extending from the back wall 30 forward along the oblong surface 20 are polarizing lugs 21.

Figure 4:
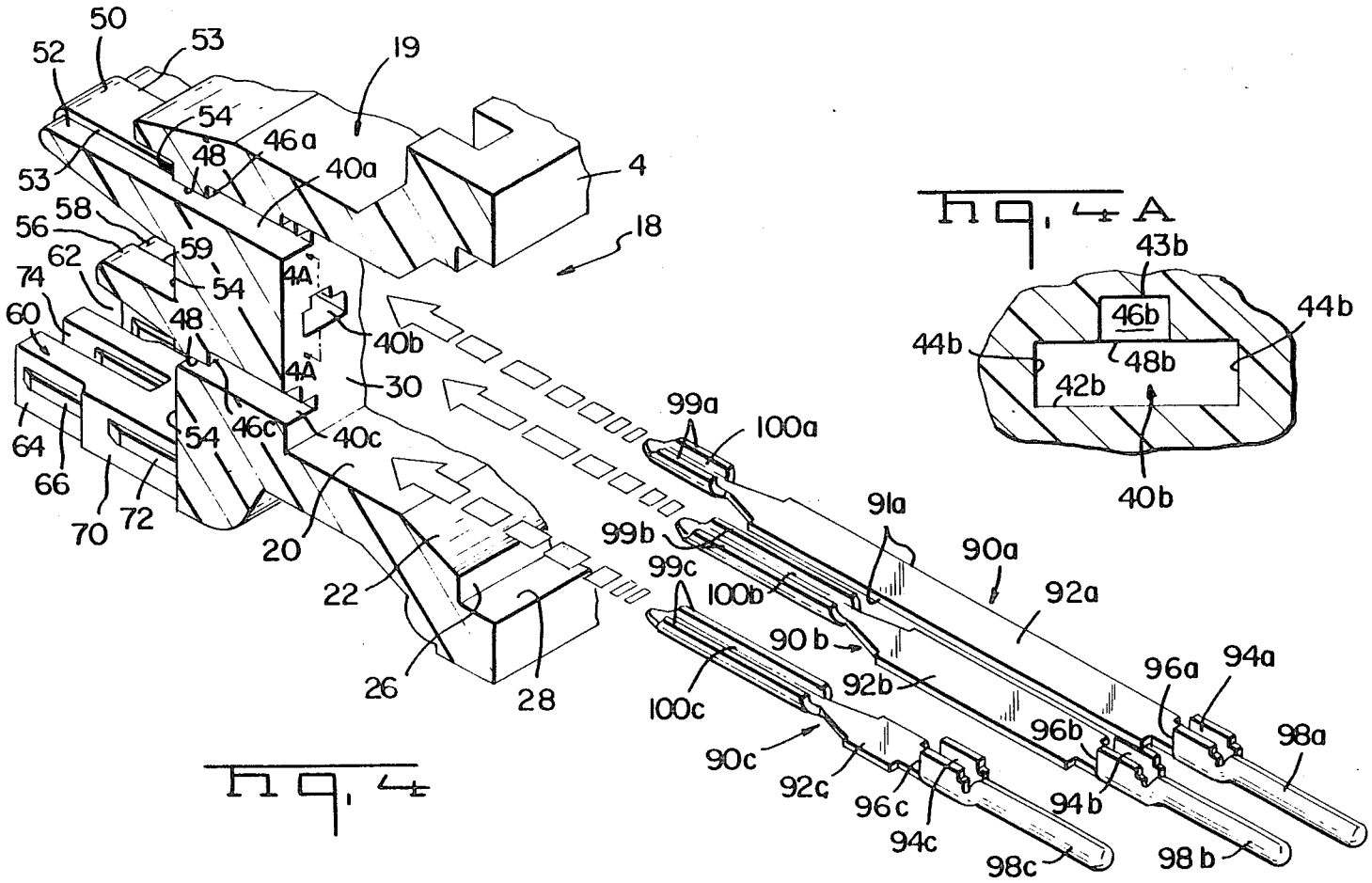
FIG. 4 is a perspective view similar to that of FIG. 3 showing the receptacle poised for receiving the respective terminals.

Still referring to FIG. 2, there is shown generally as 98, three rows of pin terminals. Referring more specifically to FIG. 4, the contacts 90A, 90B and 90C are shown in greater detail. It is apparent from FIG. 4, that each terminal differs somewhat from each other, although each contact has common constituent parts. When referring to the contact or contact constituent components, reference will be made to numerals 90–100, generally omitting the postscripts. When referring to a specific contact, reference will be made to numerals 90–100 adding the postscripts.

Contact 90A includes a long shank portion 92A having side edges 91A. On the forward end of contact 90A is contact end 100A formed by two upstanding arms 99A. At the pin end, contact 90A includes an upstanding portion 94A having a front edge 96A. The pin portion 98A is formed from the flat blank, the two flat edges rolled completely around into cylindrical configuration. Referring now to contact 90B, it can be seen that contact end 100B is formed like that of contact end 100A, yet contact end 100B is greater in length than that of contact end 100A. However, the shank portion 92B of contact 90B is shorter than that of contact 90A resulting in a decreased overall length with respect to contact 90A. Referring now to contact 90C, contact end 100C is substantially the same length as that of the contact end 100B, although the shank portion 92C is much shorter than 92B, resulting in contact 90C having a shorter overall length than that of contact 90B.

Still referring to FIG. 4, the internal structure of connector 2 is shown in greater detail. As shown in the cutaway, connector 2 has a central body portion 19, with a plurality of T-slots therein. There are three rows of T-slots, 40A, 40B and 40C, the postscripts A, B and C corresponding to the postscripts A, B and C of the contact 90. When referring to the T-slots generally, the slots and constituent surfaces 40–48 will be referred to without using the postscripts A, B, and C. When referring to specific slots and constituent surfaces, reference will be made to numerals 40–48 adding the postscripts.

Each T-slot 40 begins at cavity back wall 30 and extends further rearwardly towards the outer surface 54. As shown in FIG. 4A, each T-slot has corresponding sidewalls 44, floor 42 and ceiling 43. As the T-slot 40 extends rearwardly, the T-portion of the slot ends at surface 46; the slot thereafter having a longitudinal cross section defined by a ceiling 48.

An upper ledge 50 extends from the back wall 54, the floor 42A of T-slot 40A contiguous and in alignment with terminal channel 52, and T-slot sidewalls 44A contiguous and in alignment with channel sidewalls 53, as shown in FIG. 4. An intermediate ledge 56 extends from the back wall 54, each floor 42B of T-slot 40B contiguous and in alignment with a terminal channel 58, and T-slot sidewalls 44B contiguous and in alignment with channel sidewalls 59. T-slot 40C terminates at the back wall 54.

As best shown in FIG. 4, each T-slot 40A is in substantial vertical alignment with a respective lower T-slot 40C, while for every aligned pair of T-slots 40A and 40C, there is a center T-slot 40B laterally staggered from 40A and 40C. Below the lower row of T-slots 40C and extending from the back wall 54 is a contact locating plate, shown generally as 60. Locating plate 60 carries a plurality of laterally alternating locating slots 62 and 74. As best shown in FIGS. 4 and 8, each pair of aligned T-slots 40A and 40C is laterally aligned with locating slots 62, 68 while each center T-slot 40B is laterally aligned with locating slot 74.

As best shown in FIG. 8, each locating slot 62 is flanked by a pair of parallel opposed sidewalls 64 and extending downwardly along each sidewall 64 is a rib 66. Locating slot 62 is laterally aligned with and in transition with a lower locating slot 68. The locating slot 68, is narrower in width than the locating slot 62, slot 68 being flanked by a pair of parallel opposed sidewalls 70 and extending downwardly along the sidewalls 70 are ribs 72.

Figure 7:
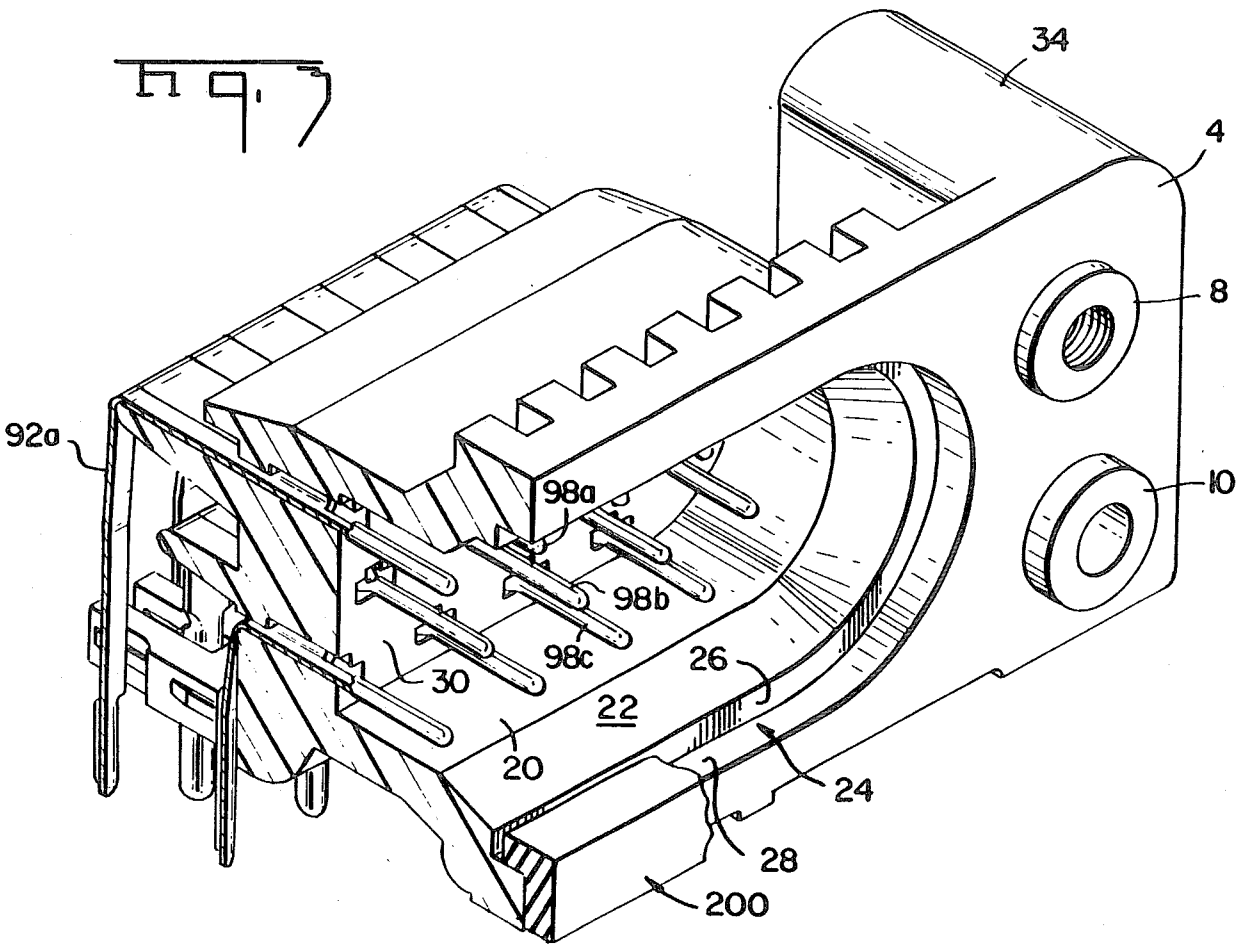
FIG. 7 is a plan view of the mounting surface of the receptacle.

Referring now to FIG. 7, the connector is shown having the mating face 4 on its side, with the mounting face 6 facing forward. Extending from the mounting face 6 are two alignment tabs 12. Also contiguous with mounting face 6 and planar thereto are mounting feet 14, having mounting holes 16 therein.

Although not part of the instant invention, FIG. 2 shows a printed circuit board 110 having two mounting holes 116 and two alignment holes 112 extending into and through the board 110. The printed circuit board 110 further includes three rows of circuit holes 120A, 120B and 120C, respectively.

Also shown in FIG. 2, but not part of the instant invention, are a gasket 200 and a bulkhead 300. The gasket 200 comprises a flat facial portion 204 and an O-ring portion 224 extending from the flat portion 204. On each end of the gasket 200 is located an insert receiving hole 208 and a boss receiving hole 210. The bulkhead 300 includes a mating face 304, two holes 308 for receiving machine screws 560 (FIG. 1) and two holes 310 for receiving self-tapping screws 314. The bulkhead 300 further includes an oblong portion 302 extending outwardly and away from face 304, as shown in FIG. 2.

Figure 11:
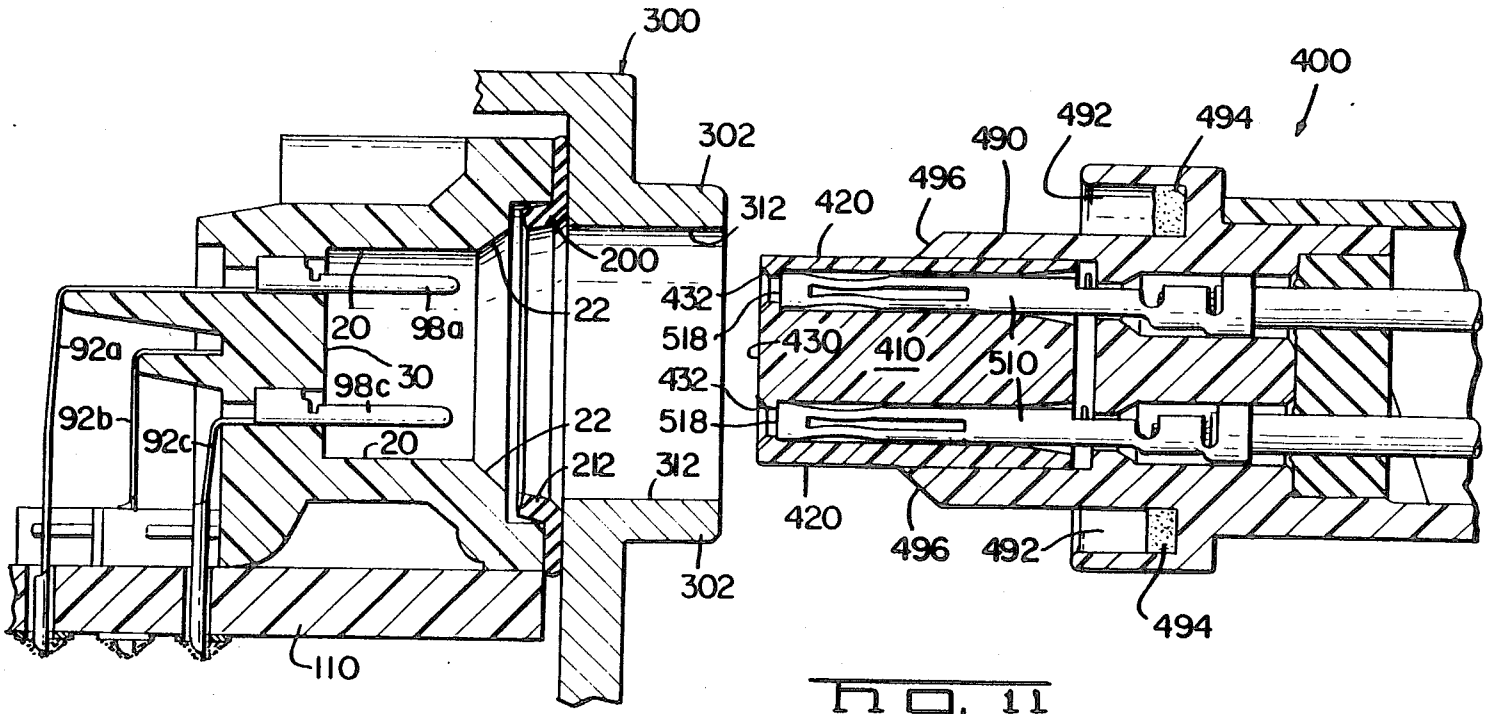
FIG. 11 is a cross-sectional view of the receptacle showing the plug section exploded away from the receptacle.

Referring now to FIG. 11, although not part of the instant invention, a plug 400 is shown which includes an insert portion 410 having a plurality of socket contacts 510 loaded therein. The plug 400 further comprises lead-in surfaces 496 contiguous with cylindrical surface 490. A peripheral channel 492 extends around the plug portion 400 acting as a gasket groove. A foam gasket 494 extends around the plug 400 on surface 490 and is seated in the gasket groove 492.

Figures 5, 6:
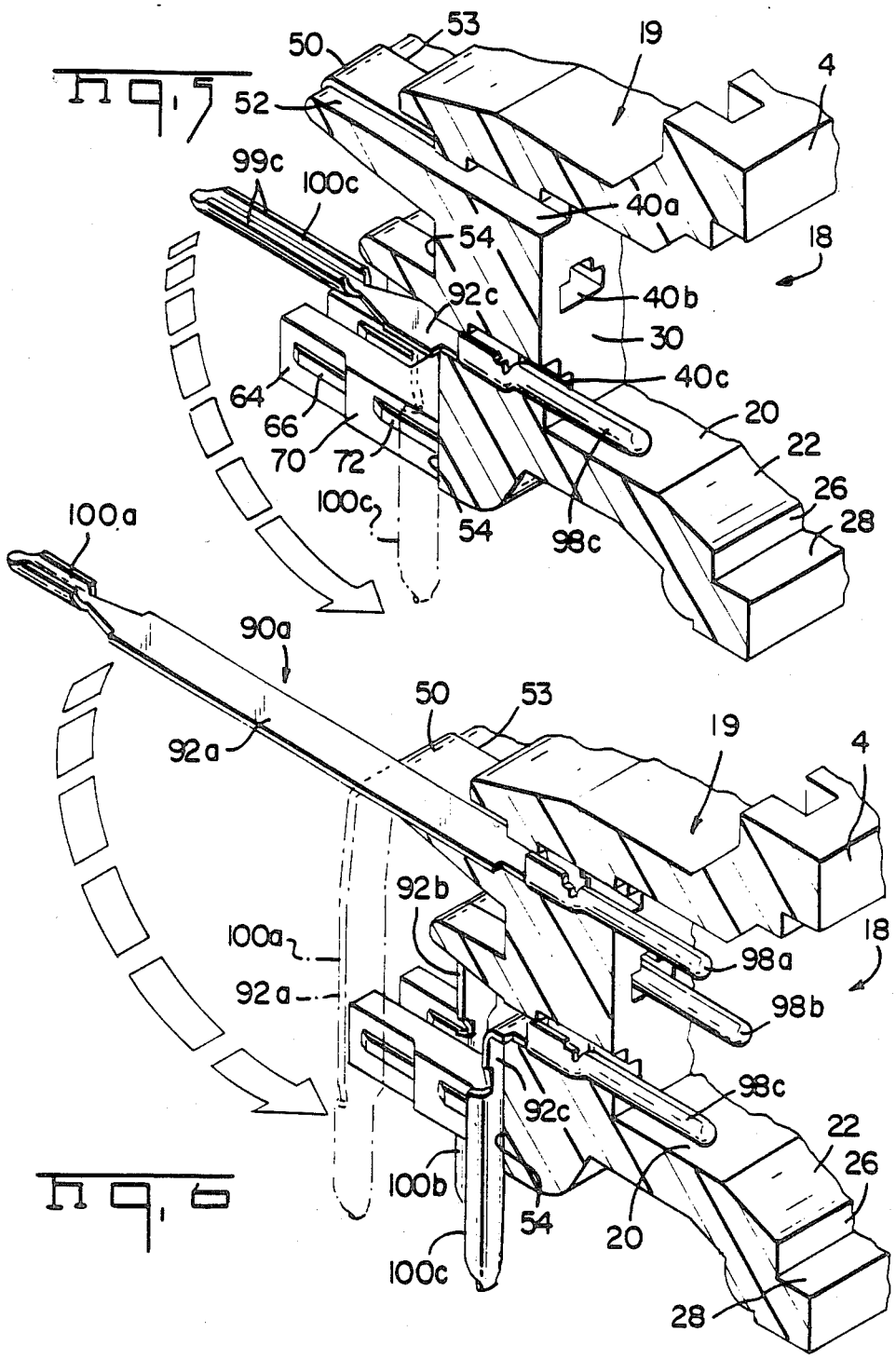
FIG. 5 is a view similar to that of FIG. 4 showing the lower terminal being bent into position.
FIG. 6 is a view similar to that of FIG. 4 showing the upper terminal being bent into position.
Figure 7:
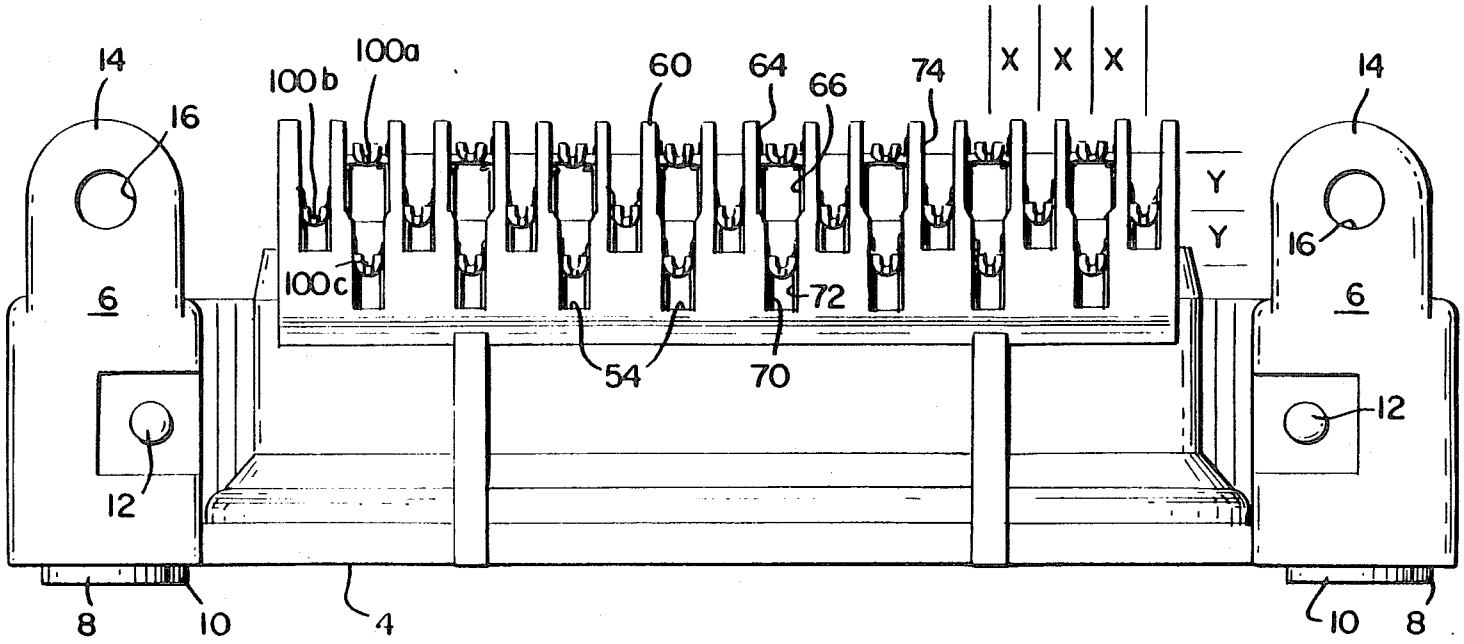

With reference now to FIG. 4, the three contact elements 90A, 90B and 90C are each shown poised for receipt in the respective T-slots 40A, 40B and 40C. The row of lower contact elements 90C are first inserted in the T-slots 40C, the contact ends 100C fitting underneath the ceiling 48C, and the shank portion 92C adjacent to the floor portion 42C. The contact elements are inserted until the forward surface 96C of the upstanding portion 94C abuts the back edge 46C of slot 40C. The contact 90C is then bent downwardly, as shown in FIG. 5, until the upstanding arms 99C of terminal end 100C are forced between the ribs 72 in the lower terminal slot 68. When the terminal end is forced into the slot 68, the upstanding walls 99C are deformed inwardly slightly, crimping them at 101C, as shown in FIG. 9, assuring an adequate interference fit.

As the upstanding walls 99C are normally biased against ribs 72, and as the ribs 72 are very narrow, the normal force of the upstanding walls 99C against ribs 72 causes the plastic in the ribs to flow over the top edges of the upstanding walls 99C to form portions 73, as shown in FIG. 8. The contact ends 99C are thereby positively seated within the slots 68 and against the ribs 72, and positively placed along a longitudinal row.

The second row of contacts 90B are then installed, each contact 90B in a respective T-slot 40B until the forward surface 96B abuts the back edge 46B. Like the installation of contact 90A, the contact 90B is then bent downwardly until the terminal end 100B is forced between the ribs 78 in termination slot 76. To assure an adequate interference fit, the upstanding arms 99B are deformed at 101B, as best shown in FIG. 10. The interaction of the upstanding walls 99B with the ribs 78 also forms a flowing portion of plastic 79 over the top edges of the upstanding walls 99B, as shown in FIG. 8.

The top row of terminals 90A are next inserted, each contact 90A is laterally aligned with a respective lower contact 90C, as shown in FIG. 6. When the contact 90A is bent downwardly, and forced into the upper terminal slot 62, it is the shank portions 92A which are forced into the slot 62, rather than the terminal ends 100A. As the shank portions are forced into the slots, the side edges 91A shear portions of the ribs 66 away from the sidewalls 64, leaving a curled end 66A, as shown in FIG. 8. As the side edges 91A only shear off a portion of the ribs 66, a thin section of the rib 66 is first sheared on both sides, with an increasingly thicker section of sheared rib as the shank portions 92A continue downward into the slot 66, wedging the shank portion into the ribs 66 of slot 62. Furthermore, the side edges 91A of the shank portion 92A are slightly crimped inwardly at 102, (FIG. 10) assuring an adequate interference fit between the shank portion 92A and the ribs 66. Once the contact portions 90 are fit in their respective slots, the connector 2 may be mounted to a printed circuit board.

As stamped and formed, the distances between surfaces 96A, 96B and 96C, and the ends of pin portions 98A, 98B and 98C, respectively are all equal. Also, in each of the T-slots 40A, 40B and 40C, the distances from the back surfaces 46A, 46B and 46C to the cavity back wall 30, are also equal. Therefore when the contacts 90A, 90B and 90C are placed in their respective slots, the contacts are positively placed with respect to each other such that the lengths of the pin portions 98A, 98B and 98C which protrude through the T-slots from the cavity back wall 30 are all equal. Furthermore, when shank portions 92A are bent downwardly around the mandrel 50, the contacts 90A are fixed in an axial direction, that is, the contact cannot be further pushed axially into the T-slot 40A, nor can it back out of the T-slot 40A.

Figure 12:
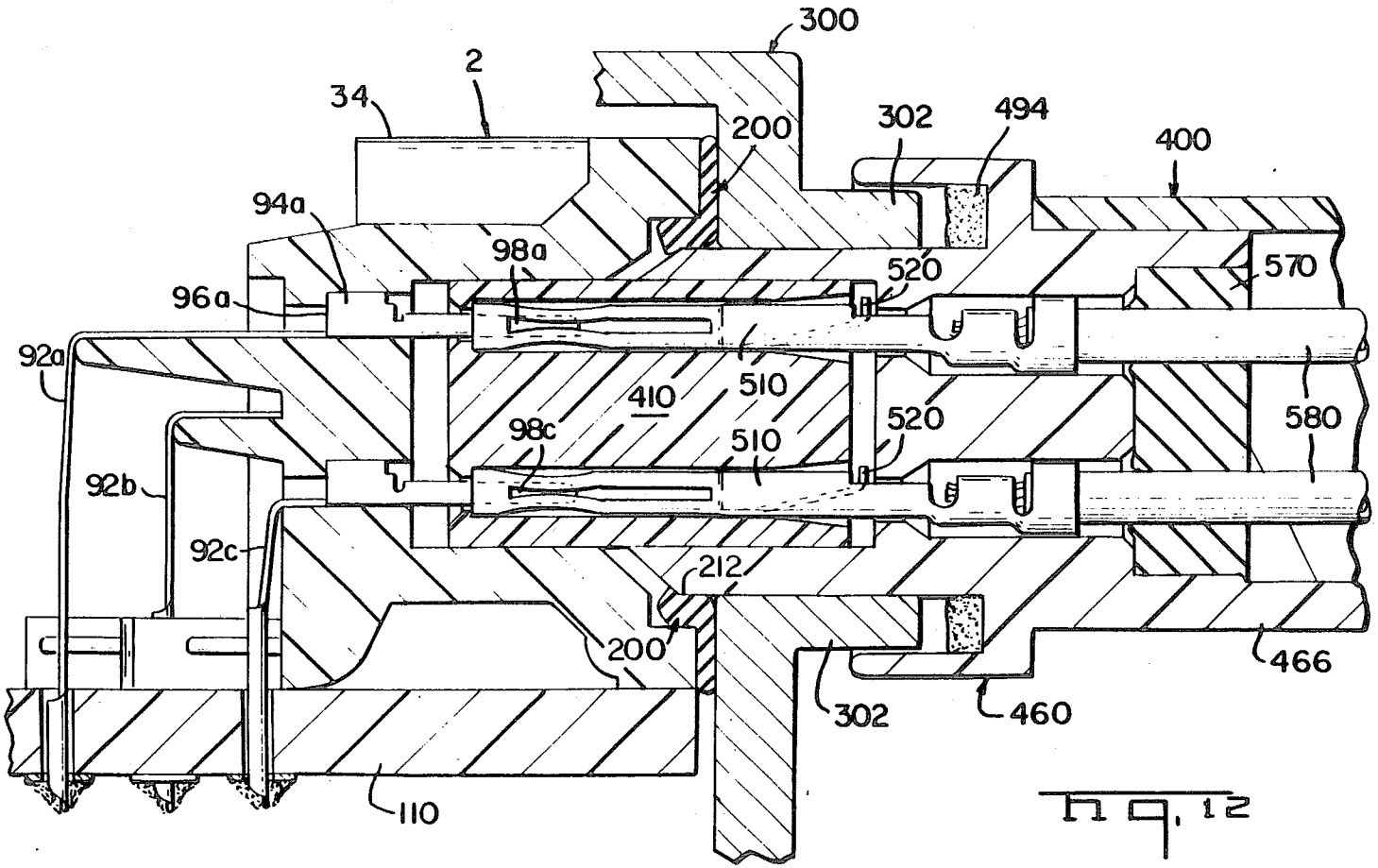
FIG. 12 is a cross-sectional view similar to that of FIG. 11 showing the receptacle and plug portions partially mated.
Figure 1:
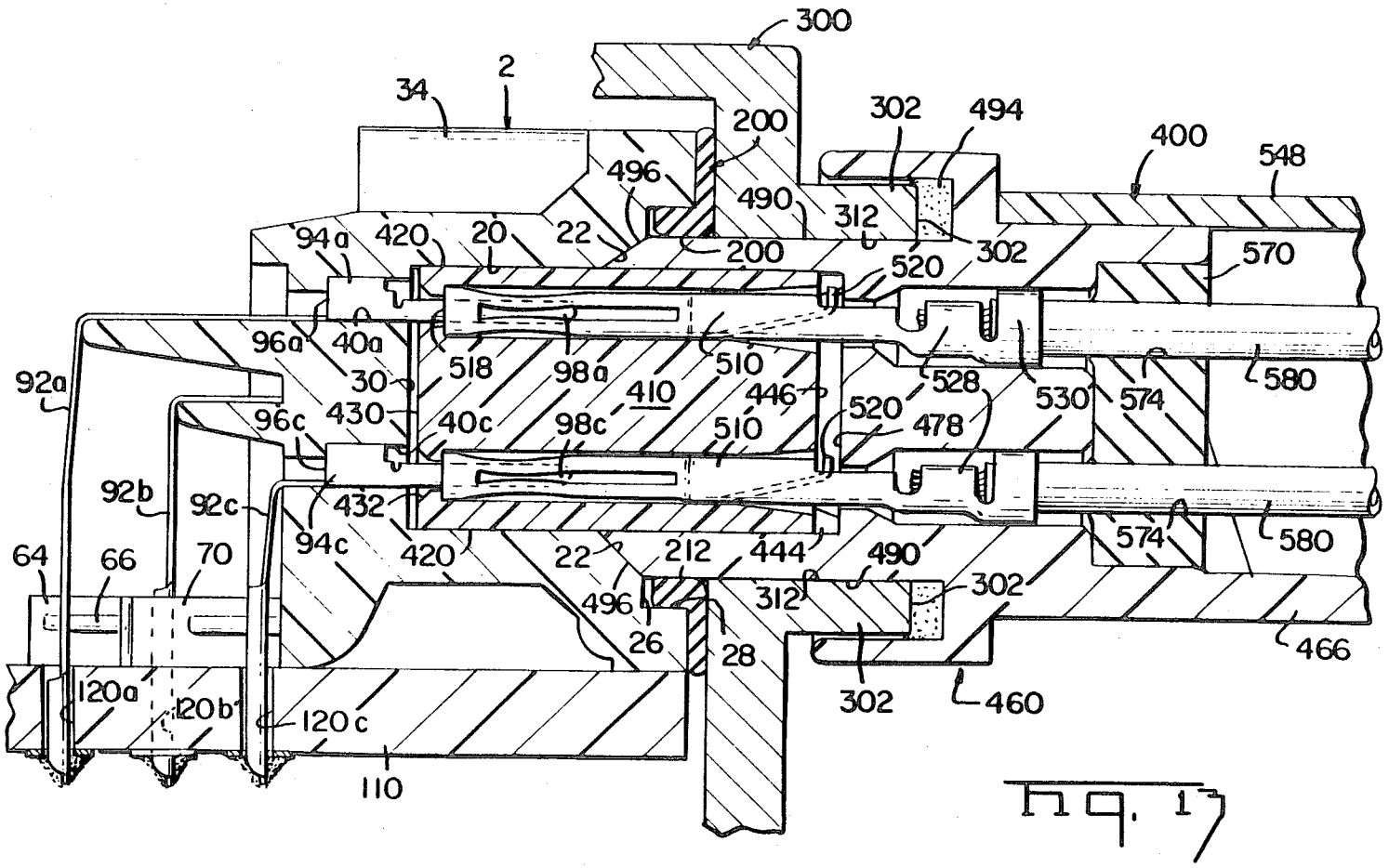

As the contacts 90B are staggered laterally of contacts 90A and 90C, and as the upper and lower contacts 90A and 90C are laterally aligned, the connector 2 provides for a high density connector for interconnection to a printed circuit board. As best shown in FIG. 2, the printed circuit board 110 comprises three rows of circuit holes 120A, 120B and 120C, respectively. In order to properly align the terminal ends 100 with the respective circuit holes 120, the connector 2 includes two alignment bosses 12 extending downwardly from the mounting face 6, the bosses extending downwardly further than the terminal ends. Thus, when the connector is lowered towards the printed circuit board 110, the alignment bosses 12 are aligned with and begin their entry into alignment holes 112, before the terminal ends 100 reach the printed circuit board 110. Further lowering of the connector 2 onto the printed circuit board extends the terminal ends 100 into their respective circuit holes 120, and the mounting face 6 of the connector 2 is lowered onto the printed circuit board 110. As best shown in FIG. 12, the terminal ends 100 may then be soldered to the circuit 122 around the circuit hole 120, interconnecting the circuit traces 124 with the contacts 90.

The connector 2 and the printed circuit board 110 are then ready for mounting on the bulkhead 200, as shown in FIG. 2. The bulkhead 300, although shown as a wall, is actually one side of a box, the box to be located locally for a system requiring the logic of the circuitry. To seal the connector and the printed circuit board from any contaminants at the local interface, a seal 200 is placed between the connector mounting face 4 and between the bulkhead mounting face 304, the surface 204 of the seal abutting the mounting surface 304 of the bulkhead 300. To secure the connector 2 to the bulkhead 300, self-tapping screws 314 are utilized, the screws 314 extending into non-threaded holes within the bosses 10. When the gasket 200 is placed onto the mating face 4 of the connector 2, the cylindrical portion 224 of the gasket extends into the gasket seal 24 of the connector 2. As the connector is drawn up snug to the bulkhead by means of the self-tapping screws 314, the flat portion 204 of the gasket 200 undergoes a slight amount of crush between the surfaces 304 and 4. Once the connector 2 is mounted to the bulkhead 300, the connector 2 is ready for receipt of the plug assembly 400.

As best shown in FIG. 11, as the plug assembly 400 is brought forward into the plug cavity 18, the contacts 98 are aligned with the socket ends 518 by means of frustoconical lead-in sections 432. The peripheral surface 212 of the gasket 200 and the peripheral surface 490 of the plug 400 are dimensioned so as to create an interference fit between them, thus continued forward motion of the plug portion 400 results in contact between the lead-in surface 496 of the housing and the outer surface 212 of the gasket 200. As the plug 400 continues inward, the lead-in portion 496 sequentially forces the outer surface 212 of the O-ring portion 224 radially outward, as shown in FIG. 12, which results in the surface 212 being planar or continuous with surface 312 and with surface 490.

When completely inserted, the front surface 430 of the insert 410 abuts back surface 30 of the cavity 18, and lead-in section 496 of the plug 400 abuts the lead-in section 22 of the connector 2, as shown in FIG. 13. When the machine screws 414 (FIG. 1) are threaded into the inserts 8, and the plug drawn up to the bulkhead, the peripheral groove 492 extends over the flange 302, the forward surface 304 of flange 302 abutting and squashing the gasket 494, as shown in FIG. 13, providing a seal between the local environment and the socket contacts 498.

We claim:

1. An electrical connector for right-angled mounting on printed circuit board, comprising:

a connector body portion having a central wall, said wall having a contact receiving face and a back face, an upper mandrel extending outwardly from an upper portion of the back face, and a contact locating wall extending outwardly from a lower portion of the back face, said contact locating wall having laterally spaced apart contact locating slots therein, the slots extending from a distal end of the contact locating wall to the back face of the central wall, a lower row of apertures extending normally into the contact-receiving face and through to the back face of the central wall, said apertures being in substantial lateral alignment with the contact locating slots, an upper row of apertures extending normally into the contact-receiving face and through to the back face of the central wall, said apertures being contiguous with said mandrel and in substantial lateral alignment with said lower row of apertures;

a first row of contact terminals disposed in the lower row of apertures having first portions lying in the apertures and second portions bent downwardly, the second portions of the contact terminals disposed in the contact locating slots;

a second row of contact terminals disposed in the upper row of apertures, having first portions lying substantially flushly along said mandrel and second portions bent downwardly and disposed in the contact locating slots characterized in that:

said contact locating slots comprise two pairs of parallel and opposed sidewalls, said first pair of sidewalls located adjacent the back face of the central wall, having means for locating the first row of contact terminals;

said second pair of sidewalls located adjacent the distal tip of said contact locating wall having a lateral spacing greater than the lateral spacing of said first pair of sidewalls, and having means to located said second row of contact terminals;

said first row of contact terminals comprising stamped and formed contacts having a pin section, an intermediate shank portion and an end section narrower than said shank portion for insertion into the printed circuit board, said terminals being so dimensioned that the end section is located between the first pair of parallel sidewalls;

said second row of contact terminals comprising stamped and formed contacts having a pin section, an intermediate shank portion and an end section narrower than said shank portion for insertion into the printed circuit board, said terminals being so dimensioned that the shank portion is located between the second pair of parallel sidewalls.

2. The electrical connector of claim 1 wherein locating means for the first row of contact terminals comprise ribs extending along the first pair of parallel and opposed sidewalls, parallel to the direction of the contact locating wall.

3. The electrical connector of claim 2 wherein the end section of each of the contact terminals in the first row includes a compliant portion having two folded and upstanding arms which is interference fit between said ribs.

4. The electrical connector of claim 3 wherein the normal force of said compliant portions against said ribs causes the plastic in said ribs to flow, forming a retention barb over said upstanding arms.

5. The electrical connector of claim 1 wherein the locating means for the second row of contact terminals comprise ribs extending along the second pair of parallel and opposed sidewalls, parallel to the direction of the contact locating wall.

6. The electrical connector of claim 5 wherein the shank portion of each said contact terminal in the second row of terminals is interference fit between said ribs.

7. The electrical connector of claim 6 wherein the shank portion of each contact terminal in the second row of contact terminals, as it is bent downwardly over said mandrel into said locating slot, shears off a portion of each said rib, said portion increasing in thickness as said shank portion extends deeper into said locating slot.

* * * * *